US007392558B2

(12) United States Patent
Fehring

(10) Patent No.: US 7,392,558 B2
(45) Date of Patent: Jul. 1, 2008

(54) METHOD AND APPARATUS FOR CLEANING SAILS

(75) Inventor: Hannes Fehring, Lagos-Algarve (PT)

(73) Assignee: Novosail International Pte., Ltd., Singapore (SG)

( * ) Notice: Subject to any disclaimer, the term of this patent is extended or adjusted under 35 U.S.C. 154(b) by 305 days.

(21) Appl. No.: 10/925,590

(22) Filed: Aug. 25, 2004

(65) Prior Publication Data

US 2005/0108847 A1 May 26, 2005

(30) Foreign Application Priority Data

Aug. 25, 2003 (DE) ..... 103 39 020

(51) Int. Cl.
*D06B 1/02* (2006.01)

(52) U.S. Cl. ..... 8/151; 8/152; 68/205 R

(58) Field of Classification Search ..... 68/202, 68/205 R

See application file for complete search history.

(56) References Cited

U.S. PATENT DOCUMENTS

| | | | | | |
|---|---|---|---|---|---|
| 242,045 | A | * | 5/1881 | Reilly | 68/9 |
| 1,723,514 | A | * | 8/1929 | Klein | 68/9 |
| 1,989,562 | A | * | 1/1935 | Smith | 68/205 R |
| 2,283,011 | A | * | 5/1942 | Mendelson | 68/85 |
| 2,366,136 | A | * | 12/1944 | Waldstein | 68/9 |
| 2,646,341 | A | * | 7/1953 | Fetscher | 8/125 |
| 3,254,778 | A | * | 6/1966 | Marland et al. | 414/159 |
| 3,518,848 | A | * | 7/1970 | Becker | 68/18 F |
| 3,701,269 | A | * | 10/1972 | Wilcox | 68/19 |
| 3,717,015 | A | * | 2/1973 | Spencer | 68/18 F |
| 3,732,072 | A | * | 5/1973 | Bahnsen | 8/149.1 |
| 3,762,869 | A | * | 10/1973 | Kennedy et al. | 8/151 |
| 3,762,870 | A | * | 10/1973 | Probst et al. | 8/151 |
| 3,763,672 | A | * | 10/1973 | Bahnsen | 68/205 R |
| 3,837,550 | A | * | 9/1974 | Levy | 226/4 |
| 3,922,738 | A | * | 12/1975 | Holm | 8/151 |
| 4,150,449 | A | | 4/1979 | Talbert | |
| 4,158,297 | A | * | 6/1979 | Winch | 68/22 R |
| 4,412,435 | A | * | 11/1983 | Gallagher | 68/22 R |
| 4,788,992 | A | * | 12/1988 | Swainbank et al. | 134/64 R |
| 4,955,212 | A | * | 9/1990 | Kutz et al. | 68/9 |
| 5,546,622 | A | * | 8/1996 | McAlister et al. | 8/151 |

FOREIGN PATENT DOCUMENTS

| | | | |
|---|---|---|---|
| DE | 53669 | | 11/1967 |
| DE | 3739346 | | 6/1989 |
| DE | 3900474 | | 6/1990 |
| DE | 29708256 | | 7/1997 |
| DE | 29823523 | | 7/1999 |
| JP | 58-22790 | * | 2/1983 |

OTHER PUBLICATIONS

European Patent Office 0 316 859 Nov. 1988.*
European Patent Office 0 357 926 Jul. 1989.*
Rouette, H.K.: Handbuch Der Textilveredlung., I Band, Deutscher Fachverlag GmbH, Frankfurt am Main, 2003 ISBN: 3-87150-728-8, pp. 607-617.

* cited by examiner

*Primary Examiner*—Frankie L. Stinson
(74) *Attorney, Agent, or Firm*—Dilworth & Barrese, LLP.

(57) ABSTRACT

The present invention relates to a method and an apparatus for cleaning flat fabrics, especially sails for sailboats, in which at least one cleaning solution is applied to the flat fabric in a washing apparatus. According to the invention, it is provided that the flat fabric is moved forward continuously in its spread-out state through several cleaning stations arranged along a horizontal, planar conveyance track, without tumbling or serpentine back-and-forth bending.

34 Claims, 2 Drawing Sheets

METHOD AND APPARATUS FOR CLEANING SAILS

BACKGROUND OF THE INVENTION

The present invention relates in general to a method for cleaning flat fabrics, especially sails for sailboats, in which at least one cleaning solution is applied to the flat fabric in a washing apparatus. The invention relates furthermore to a cleaning apparatus for cleaning such flat fabrics, especially sails.

Large, cumbersome flat fabrics like sails cannot reasonably be cleaned using conventional methods. Yacht sails often reach a size of over 100 $m^2$ and are made of stiff, often tempered sail fabric that must be creased as little as possible, because creases damage the tempering and can cause the sail to lose its shape. Conventional washing methods, in which the fabric to be washed is placed in a washing drum, wetted, and washed, are not suitable for sails and similar flat fabrics. The sheer size alone and the corresponding weight of the sail make it impossible to place it easily in a washing drum. In addition, several washing cycles have to be carried out for which several separate volumes of washwater must be used since the washwater made dirty by the rough cleaning at the beginning cannot be used for a later washing cycle. The various washing cycles and rinsing cycles result in a high consumption of water, energy, and time in conventional cleaning methods. Moreover, the back-and-forth tumbling usually causes damage to the sail fabric.

SUMMARY OF THE INVENTION

The present invention is therefore based on the task of creating an improved cleaning method and an improved cleaning apparatus that will avoid the drawbacks of the prior art and will develop the prior art further in an advantageous manner. Preferably, a gentle and at the same time resource-saving cleaning process will be achieved for large-surface flat fabrics like sails.

This task is solved according to the invention using a method for cleaning flat fabrics (5), especially sails for sailboats, in which at least one cleaning solution is applied to flat fabric (5) in a washing apparatus (30), wherein flat fabric (5) is moved continuously forward through washing apparatus (30) in its spread-out state. In terms of the apparatus, the task is solved by a cleaning apparatus having a conveyor track, several cleaning stations (10, 17) arranged sequentially along the conveyor track, and a conveyance mechanism to move the flat fabric forward continuously through cleaning stations (10, 17) in its spread-out state. Preferred embodiments of the invention also form the subject matter herein.

Thus, according to the invention, the flat fabric in its spread-out state is moved continuously through the washing apparatus in which at least one cleaning solution is applied to the flat fabric. Continuously means that the flat fabric is moved through the washing apparatus section by section. Preferably this is done without interruption, however a stop-and-go process is possible, for example to allow heavily soiled sections of fabric to be impacted longer. For this purpose, the cleaning apparatus according to the invention can encompass a conveyor track and several cleaning stations arranged sequentially along the conveyor track, with a conveyance mechanism being provided in order to move the flat fabric continuously forward through the washing station in its spread-out state. This method is especially well-suited for cleaning sails, as they are protected from creasing by being moved forward through the washing apparatus in their spread-out state. In contrast to conventional washing drums, the cleaning is done without tumbling.

In a further development of the invention, the cleaning solution is recycled back in the direction opposite the forward motion of the fabric and is used at various sections of the washing apparatus. The cleaning solution is first used downstream in terms of the direction of forward motion of the flat fabric and then it is used further upstream. For this purpose, in terms of the technology of the apparatus, a recycling mechanism can be provided for recycling used cleaning solution backwards between the cleaning stations, by means of which the cleaning solution already used at one washing station can be conveyed to another washing station positioned ahead of this one. On the one hand, this saves cleaning solution, preferably consisting of water and cleaning chemicals. On the other hand, this manner of reusing washwater or cleaning solution does not diminish its effectiveness, because the recycling is done in the direction opposite the forward motion of the fabric. At washing stations positioned further down, the sail fabric is already relatively clean, so that the cleaning water is only made a little dirty, and can be used over again at the cleaning stations positioned further up at which the sail is still significantly dirtier.

The cleaning stations are preferably arranged sequentially in such a way that different sections of the flat fabric can be treated simultaneously at different cleaning stations. Cleaning by section with simultaneous treatment of several sections allows for parallel timing of the major operations, that is, the time required for one cleaning station can overlap with the time required for another cleaning station.

Preferably, the fabric to be cleaned is guided through the washing apparatus along a horizontal conveyor track, while a gradient between the cleaning stations can be used to recycle the cleaning solution backwards. In particular, a conveyance line can be provided for the cleaning solution, sloping upwards in the direction of forward motion of the fabric, so that the cleaning solution or rinsing water from a cleaning or rinsing station positioned later in the sequence can be conveyed by gravity to a cleaning or rinsing station positioned earlier in the sequence.

As a further development of the invention, the flat fabric is guided sequentially through several washing or cleaning stations supplied with cleaning fluid and arranged along a planar, horizontal track.

In order to prevent creasing or tumbling as much as possible, the conveyor track can comprise several flat support surfaces arranged sequentially that are positioned to be level or at most slightly bent uniaxially in the direction of forward motion of the fabric. Designing the conveyor track in such a way that the flat fabric is not tumbled and does not undergo any bending as it moves along the conveyor track brings the advantage that the stiff sail is conveyed through the washing apparatus gently and smoothly. It is also advantageous for the conveyor track not to have any bend or curve perpendicular to the direction of conveyance.

At the exit point of each cleaning station, a separator will preferably be provided, especially a suction device, to remove residual cleaning solution or rinsing water from the flat fabric as it leaves the respective washing station. This can help to prevent dissolved dirt particles from being conveyed from one cleaning station to the next.

As a further development of the invention, each cleaning station has at least one roller positioned perpendicular to the direction of forward motion, by aid of which the fabric to be cleaned can be neatly conveyed into the washing station and out of it again, so that the fabric is essentially guided along on the washing support surfaces. The washing support surfaces can preferably have side walls so that they can be filled with cleaning solution and/or rinsing solution. The fabric is guided through the corresponding bath of cleaning solution or rinsing solution.

The washing stations can each have at least one mechanical cleaning element to remove coarse dirt, in particular a cleaning brush, which can be moved across the surface of the fabric. In particular, the cleaning stations can each be provided with two cleaning rollers that are positioned on opposite sides of the fabric as it passes through the cleaning station and that brush across the fabric in the reverse direction. The aforementioned cleaning rollers may comprise the previously mentioned conveyance rollers or work together with them.

Preferably, several pairs of cleaning rollers and pairs of conveyance rollers are arranged alternatingly in sequence along a level conveyor track. Between the pairs of cleaning rollers and conveyance rollers, preferably level support surfaces can be provided that will support the sail fabric between the pairs of rollers. The rollers, which would touch one another along a line if the sail fabric were not running between them, are preferably arranged in a common plane with this line of contact, with this plane being defined by the support surfaces lying between the pairs of rollers. In this way, the sail can be guided through the stations without creasing or tumbling. The overall arrangement of the washing apparatus is advantageously horizontal, that is, the sail fabric is conveyed continuously from washing cycle to washing cycle on a horizontal table, so to speak, along which the pairs of cleaning and conveyance rollers are arranged.

The cleaning rollers can have a diameter that is different from the diameter of the conveyance rollers. In particular, the conveyance rollers can have a smaller diameter. In order to improve the cleaning effect of the cleaning rollers, they can be driven at a peripheral speed that differs from the peripheral speed of the conveyance rollers, so that the cleaning rollers brush across the sail fabric, that is, they carry out a relative movement. In particular, the conveyance rollers can run at a somewhat faster peripheral speed, so that the cleaning or washing rollers act as a drag on the sail fabric, so to speak, which creates a brushing effect. By the same token, the sail fabric is pulled tight on its way through the cleaning stations. Alternatively, or in addition, it could also be provided that roller pairs positioned later in sequence would run at a faster peripheral speed than roller pairs positioned earlier. This would also pull the sail fabric tight between the roller pairs, for one thing, and at the same time it would create a brushing effect.

The cleaning stations advantageously comprise a main washing station that has a fresh water feed and a cleaning solution dosing mechanism. A pre-washing station is positioned earlier in sequence than the main washing station, and can be linked to the main washing station via a cleaning solution recycling mechanism, so that the cleaning solution used at the main washing station, preferably consisting of water and cleaning chemicals, can be recycled back to the pre-washing station once it has reached a certain degree of soiling. A fresh water feed and/or cleaning solution dosing mechanism can be provided additionally at the pre-washing station in order to add in fresh water or add extra cleaning chemicals.

A wetting station is preferably positioned earlier in sequence than the pre-washing station, at which the fabric to be cleaned can be wetted or soaked. Preferably the wetting station is connected via a fluid line to a rinsing station positioned later in sequence than the main washing station, so that the rinsing water used at the rinsing station can be used to wet the fabric to be cleaned at the entry point to the washing apparatus.

In particular for the cleaning of sails, a cleaning station is provided as a supplemental treatment station that is positioned later in sequence than the main washing station, which has an application mechanism for applying supplemental treatment or processing agents.

At the downstream end of the washing apparatus, a drying and pressing station is provided in addition, which can be designed in various ways. It can advantageously have a support surface that can be heated using a heating system. An air fan can be positioned later in sequence than the support surface, by means of which the last residues of moisture can be removed from the fabric.

The cleaning apparatus can be designed in various ways with regard to the conveyance mechanism. An advantageous embodiment consists in the conveyance mechanism having endlessly rotating conveyance means, especially chains or belts, between which the fabric to be moved forward through the washing apparatus is held tight and that are in constant contact with the fabric while running along in the direction of forward motion. The fabric is carried along by the chains or belts and guided accordingly through the washing apparatus, that is, its cleaning stations. In addition or alternatively, the conveyance mechanism can consist of conveyance rollers that are driven in a rotating manner perpendicular to the direction of forward motion of the fabric and over which the fabric is passed. Rollers can be provided that are coupled in pairs, between which the fabric is moved forward. It is also conceivable to press the rollers against the support surfaces of the conveyor track in order to move the fabric forward.

BRIEF DESCRIPTION OF THE DRAWINGS

The invention is explained in greater detail below using a preferred embodiment and a corresponding drawing. In the drawing.

DESCRIPTION OF THE PREFERRED EMBODIMENTS

Figure 1:
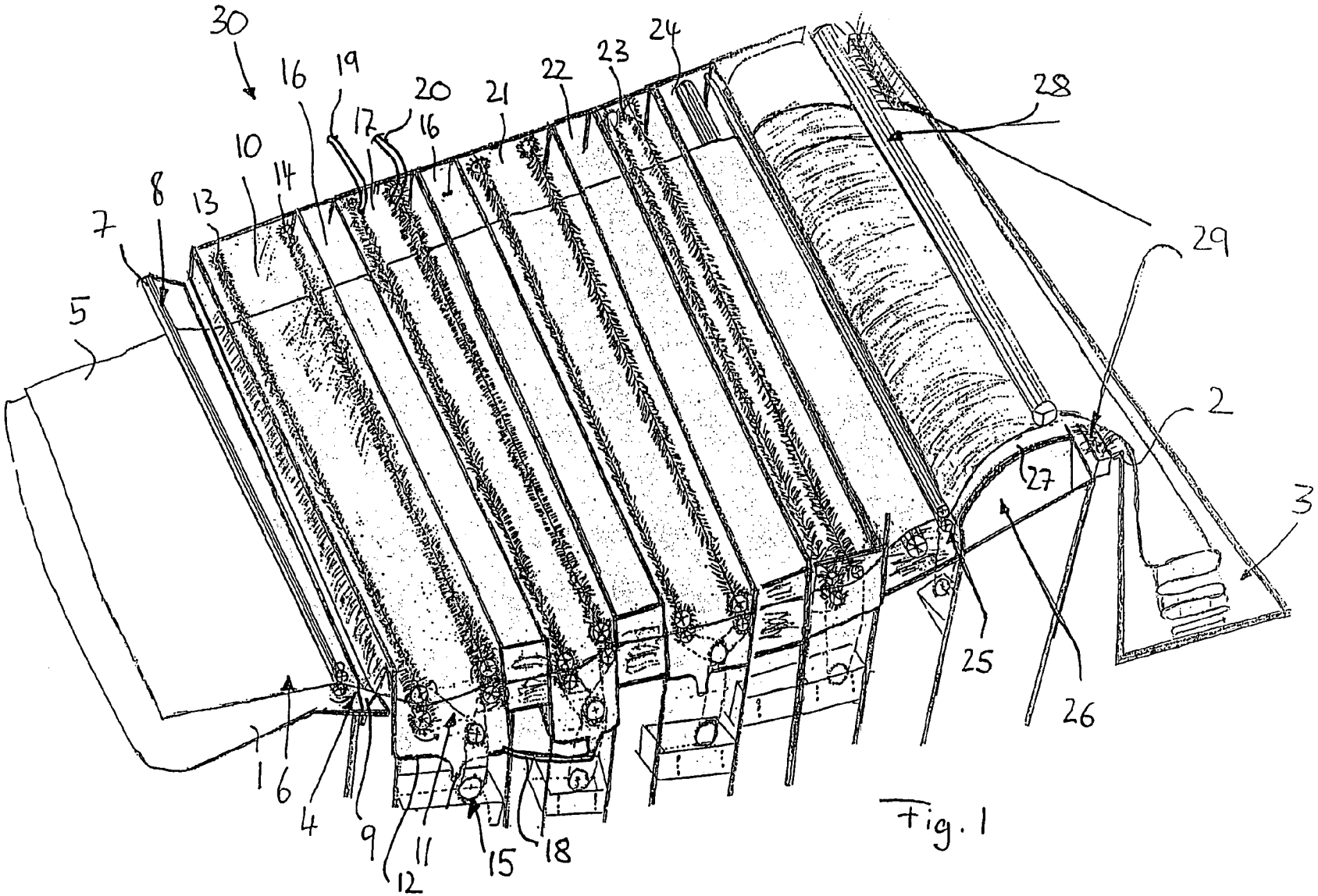
FIG. 1: shows a schematic, perspectival view of a cleaning apparatus according to a preferred embodiment of the invention.

The cleaning apparatuses shown in the drawings are structured in a modular fashion and comprise several sequentially arranged cleaning, rinsing, supplemental treatment, and drying stations that can be exchanged or arranged in different order depending on the application. They constitute a horizontal conveyance track for the sail fabric to be cleaned, beginning with input table 1 and ending with output 2, to which a receptacle 3 is adjoined in which the cleaned fabric is stored temporarily.

In the embodiment according to FIG. 1, a conveyance mechanism 4 is provided between input table 1 and output 2 in the form of two endlessly rotating conveyance belts positioned at each edge that is not shown in detail in the drawing. They move sail fabric 5, which is to be cleaned, continuously forward through all stations.

Input table 1 forms a pre-cleaning station 6, at which coarse dirt can be removed, perhaps by hand, or treated and rinsed off using cleaning chemicals. At the downstream end of input table 1, the sail fabric runs through two rollers 7 that roll against one another and are driven in opposite directions. Even before the sail fabric reaches the first automatic cleaning station, it is wetted at a wetting station 8 using rinsing water that is fed by rinsing water from a rinsing station arranged later in sequence than the washing stations. The residues of rinsing water and coarse dirt yet remaining on the fabric are removed by means of a suction station, so that they are not conveyed into the first actual washing station.

Suction station 9 can comprise a sink running perpendicular to the direction of forward motion, to which a partial vacuum is applied. The sail fabric moved forward by conveyance mechanism 4 then proceeds to pre-washing station 10. As shown in FIG. 1, pre-washing station 10 comprises a washing trough 11 extending perpendicular to the direction of forward motion, which is limited at its base by a washing trough support 12. Roller pairs 13 and 14 running adjacent to one another are positioned at an input area and an output area in washing trough 11, with the sail fabric being passed and conveyed between them. Roller pairs 13 and 14 each encompass brush rollers that are driven in opposite directions by means of a drive mechanism 15 in such a way that a brush roller is driven on each side of the sail fabric against the direction of forward movement of the sail fabric, so that it brushes across the sail in the opposite direction and scrubs dirt off of it.

A suction device 16 is positioned at the output of pre-washing station 10 which likewise extends perpendicularly across the track of fabric to be moved forward.

Suction device 16 can also have strippers, separator rolls, and other suitable means to remove residual water.

Thereafter, main washing station 17, which is structured similarly in principle to the previously described pre-washing station 10, is positioned later in sequence than pre-washing station 10. It likewise encompasses two roller pairs 13 and 14 that are driven by a drive mechanism 15. Another suction device 16 is then positioned later in sequence than main washing station 17. Main washing station 17 is connected to pre-washing station 10 via a recycling mechanism 18 that is not shown in detail in the drawing. In the simplest case, it can consist of a line and a blocking valve and can have a feed pump, if necessary. Recycling mechanism 18 serves to recycle the washwater used in main washing station 17 back to pre-washing station 10, at which the washwater already used at the main washing station is used again. Main washing station 17 itself is supplied with fresh water via a fresh water feed 19 and with cleaning solution or chemicals via a cleaning solution dosing mechanism 20. Obviously, pre-washing station 10 can likewise have a corresponding fresh water feed and cleaning solution dosing mechanism in order to add additional fresh water and/or cleaning chemicals.

Suction device 16 positioned after pre-washing station 10 and/or after main washing station 17 encompasses advantageously in each case a rinsing water feed in order to rinse the sail fabric following the washing stations. Suction device 16 thus forms a rinsing station at the same time. Advantageously, the suction station is provided on one hand with a pressurized rinsing device and on the other hand with a suction device.

After passing the main washing station, the continuously fed sail fabric is moved forward to processing station 21. This is structured similarly in principle to the previously described pre-washing and main washing stations. However, at processing station 21 there is no washwater in the washing trough, but rather a processing bath consisting of suitable processing substances. As shown in the Figure, processing station 21, too, encompasses the previously described arrangement of roller pairs 13 and 14 with the corresponding drive mechanism.

Following processing station 21, additional supplemental treatment stations 22 and 23 are provided that in turn in their structure correspond in principle to previously described washing stations 10 and 17 and have roller pairs as well as a drive mechanism. A supplemental finishing bath is held ready at supplemental treatment station 23. Instead of a bath, the supplemental treatment substances can obviously also be sprayed on.

Finally, after supplemental treatment station 23, the sail fabric passes through setting station 24, at which the supplemental substances applied previously are set. Setting station 24 can in principle be structured in the same way as the washing stations previously described and can keep a setting bath ready. Alternatively, the setting substance can be sprayed on.

At the output end of station 24, a pair of water extraction rollers 25 are provided that serve to remove residual moisture and form the entrance to drying station 26. Water extraction rollers 25, which are likewise arranged perpendicular to the direction of forward motion, run adjacent to one another and are advantageously pressed against one another so that the fabric fed through them is squeezed, so to speak, in order to remove water that remains on it. Drying station 26 encompasses a heatable support surface 27, later in sequence than water extraction rollers 25, over which the sail fabric is guided. The heatable surface causes evaporation of moisture that still remains on the sail fabric. A pressing roller 28 ensures that the sail fabric in fact runs across heated support surface 27. A fan 29 is positioned later in sequence than support 27, by means of which the last residual moisture can be removed.

Following drying station 26, the sail fabric moves into storage receptacle 3.

Figure 2:
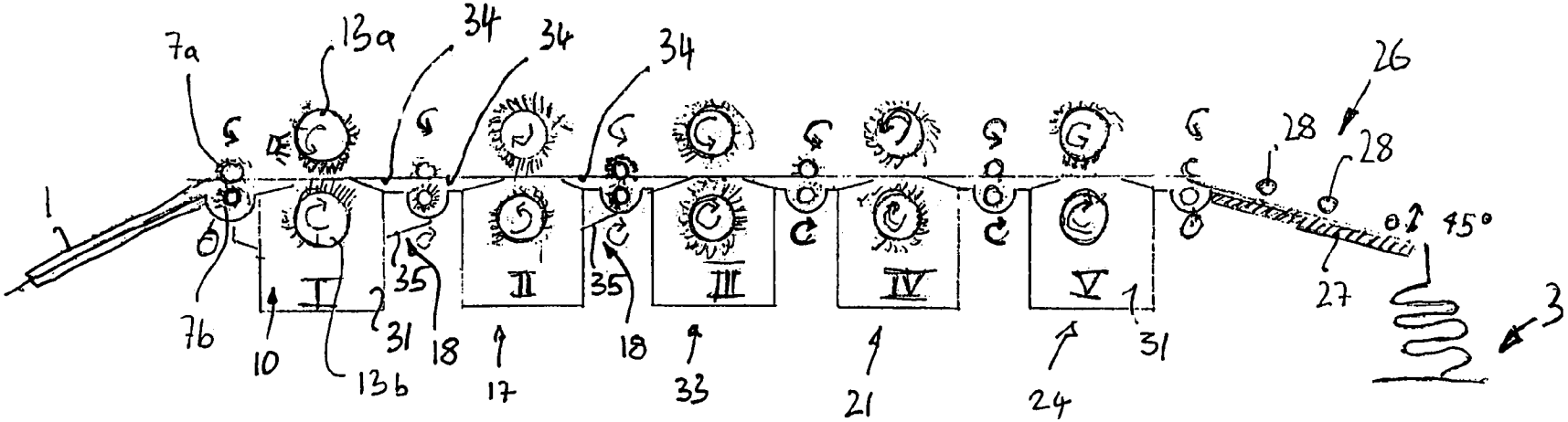
FIG. 2: shows a schematic side view of a cleaning apparatus according to another preferred embodiment of the invention.

An alternative embodiment of a cleaning apparatus is shown in FIG. 2. The basic difference vis-à-vis the previously described embodiment is the design of the conveyor track at the cleaning stations, in particular the provision of a basically totally level conveyor track without washing troughs. Similar to the previously described embodiment, a sloping input table 1 is provided at the upstream end of the washing apparatus, over which a sail to be cleaned is fed to a first conveyance roller pair 7*a* and 7*b*. The pair of conveyance rollers 7*a* and 7*b* run in opposite directions in relation to one another, so that the sail fabric is moved forward between rollers 7*a* and 7*b*, with their rotational axes extending basically horizontally and perpendicular to the direction of forward motion of the sail fabric.

A first washing station positioned later in sequence than conveyance roller pair 7*a* and 7*b* is designed as a pre-washing station 10 and encompasses two cleaning rollers 13, 14 that can be driven in opposite directions so that the sail fabric can pass through rollers 13 and 14. Cleaning rollers 13 and 14 are designed as brushes and extend with their rotational axes parallel to one another basically horizontally and perpendicular to the direction of forward motion of the sail. As shown in FIG. 2, lower cleaning roller 13*b* is positioned in a cleaning solution receptacle or container 31, so that its lower half is wetted by the cleaning solution in cleaning solution container 31, so that cleaning roller 13*b* applies the cleaning solution to the sail fabric passing between the cleaning rollers.

In addition or alternatively, cleaning rollers 13*a* and 13*b* can have integrated cleaning solution spray nozzles by aid of which the cleaning solution is sprayed onto the sail fabric as it passes through the rollers. Furthermore, cleaning solution spray nozzles 32 can also be provided separate from cleaning brush rollers 13*a* and 13*b* to spray the cleaning solution onto brush rollers 13*a*, 13*b* and/or directly onto the sail fabric as it passes through the brush rollers.

Similar to the previously described embodiment, a main washing station 17, a follow-up cleaning and rinsing station 33, a processing and supplemental treatment station 21 and finally a setting station 24 are positioned after pre-washing station 10, all of which have the same fundamental structure as pre-washing station 10, with a roller pair 13*a* and 13*b* running adjacent to one another, a cleaning solution or supplemental substance or setting substance container 31, and corresponding spray nozzles 32. Conveyance roller pairs 7*a* and 7*b* running adjacent to one another, which in principle can correspond to the conveyance roller pair provided at the end of input table 1, are provided between each of the sequentially arranged washing stations and supplemental treatment and setting stations.

As shown in FIG. 2, cleaning rollers 13*a* and 13*b* and conveyance rollers 7*a* and 7*b* of the respective stations are all arranged horizontally, parallel to one another, and perpendicular to the direction of forward motion of the washing apparatus. They constitute a basically level conveyor track for the sail that is to be cleaned, that is, they all lie symmetrically at a similar distance above and/or below a common horizontal plane. The gaps for passage between the roller pairs lie in a common plane.

Between the roller pairs 7*a*, 7*b* and 13*a*, 13*b*, level support surfaces 34 are provided that will support the sail fabric between the roller pairs. Support surfaces 34 are arranged horizontally and together form a level, horizontal conveyance surface in the form of a table.

As shown in FIG. 2, a recycling mechanism 18, for recycling the cleaning solution used in each station back to the station located prior to it, is provided between main washing station 17 and pre-washing station 10, as well as between follow-up cleaning or rinsing station 33 and main washing station 17. These recycling mechanisms 18 can operate based on the principle of gravity. In the embodiment shown in the drawing, they comprise sloping recycling tracks 35 arranged to slope down to the respective washing station positioned earlier.

Another conveyance roller pair 7*a*, 7*b*, that can be designed as water extraction rollers to remove residual moisture, is provided following the output end of setting station 24. In the embodiment shown in FIG. 2, a drying station 26 is also provided following washing apparatus 30 that encompasses a heatable, steeply sloping support 27, positioned after the aforementioned rollers 7*a*, 7*b*, over which the sail fabric is passed. Heatable support 27 causes evaporation of moisture that still remains on the sail fabric. Pressing rollers 28 ensure that the sail fabric in fact runs across heated support surface 27. A fan can be positioned later in sequence than support 27, by means of which the last residual moisture can be removed.

Following drying station 26, the sail fabric moves into storage receptacle 3.

The described continuously running cleaning apparatus with recycling of the cleaning water against the direction of flow of the fabric possesses great advantages in terms of water and energy consumption. In addition, the conveyance of the fabric in its spread-out state is gentle on the fabric and preserves it against creasing. A preferred application of the cleaning apparatus is for the cleaning of sails. Potentially, however, other large-surface flat fabrics such as tablecloths, curtains, and bed sheets can also be cleaned using the described cleaning apparatus.

The invention claimed is:

1. Method for cleaning sails for sailboats, in which at least one cleaning solution is applied to a sail (5) in a washing apparatus (30), wherein sail (5) is moved continuously forward through individually compartmented and spaced apart cleaning stations in washing apparatus (30) in a spread-out state of the sail, wherein the washing apparatus includes a plurality of spaced-apart level support surfaces positioned in a common plane alone which the sail is moved, said sail being in moving contact with said support surfaces, a plurality of pairs of conveyance rollers having respective lines of contact along said common plane, a pair of downstream rollers turned at a higher speed than the conveyance rollers so as to impart tension to the sail, and at least one pair of cleaning rollers located between at least two of the pairs of the conveyance rollers and positioned so as to contact and clean both sides of the sail.

2. Method according to claim 1, with cleaning solution previously applied to a preceding section of the sail being applied to a subsequent section of the sail and/or with the cleaning solution from a downstream section of the washing apparatus being conveyed to an upstream section of the washing apparatus.

3. Method according to claim 1, with the sail (5) being moved forward in washing apparatus (30) through several sequentially arranged cleaning stations (10, 17), with different sections of the sail (5) being treated at the same time at different cleaning stations (10, 17).

4. Method according to claim 1, with the sail (5) being guided sequentially through several washing or cleaning stations (10) supplied with cleaning fluid and arranged along a horizontal conveyor track.

5. Method according to claim 1, with the sail (5) being moved forward through washing apparatus (30) without tumbling along a basically level conveyor track.

6. Method according to claim 5, with the sail (5) being supported, during its conveyance through several sequentially arranged cleaning stations (10), by several sequentially arranged level support surfaces between these cleaning stations (10).

7. Method according to claim 5, with the sail (5) being guided through several sequentially arranged cleaning roller pairs, whose paired lines of contact or rolling lines are positioned in a common plane, and whose rotational axes are arranged in parallel to one another.

8. Method according to claim 1, with the sail (5) being guided through cleaning roller pairs and conveyance roller pairs arranged sequentially in alternating fashion, constituting a level conveyor track for the sail (5), and operated at different peripheral speeds.

9. Method according to claim 1, with washing or cleaning solution being applied to the sail (5), which is to be cleaned, using rotating cleaning rollers (14) that dip into the cleaning solution to be applied and/or possess cleaning solution outlet openings, in particular spray nozzles.

10. The method of claim 1 further including the step of removing at least some fluid from andlor applying fluid treatment to the fabric between the compartmented cleaning stations.

11. The method of claim 1 comprising the step of cleaning both sides of the sail (5) at the same time.

12. The method of claim 11 comprising the step of transporting the sail above cleaning solution in the individually-compartmented and spaced-apart cleaning stations and applying cleaning solution to the sail by pairs of rollers through which the sail passes.

13. Method of claim 1 including contacting the sail with a stationary heated support surface (27) to dry the sail by evaporation.

14. Cleaning apparatus for cleaning sails for sailboats, the cleaning apparatus having a conveyor track, several individually compartmented and spaced apart cleaning stations (10, 17) arranged sequentially along the conveyor track, and a conveyance mechanism to move the sail forward continuously through cleaning stations (10, 17) in its spread-out state wherein the cleaning apparatus includes a plurality of spaced-apart level support surfaces positioned in a common plane along which the sail is moved, said sail being in moving contact with said support surfaces, a plurality of pairs of conveyance rollers having respective lines of contact along said common plane, a pair of downstream rollers turned at a higher speed than the conveyance rollers so as to impart tension to the sail, and at least one pair of cleaning rollers located between at least two of the pairs of the conveyance rollers and positioned so as to contact and clean both sides of the sail.

15. Cleaning apparatus according to claim 14, with a recycling mechanism (18) being provided between at least two cleaning stations (10, 17), for recycling used cleaning solution used at one cleaning station back to a cleaning station (10) positioned ahead of this cleaning station (17).

16. Cleaning apparatus according to claim 15, with recycling mechanism (18) having a gravity-operated conveyance, in particular an inclined cleaning solution recycling track that slopes downward to the cleaning station (10) positioned earlier in sequence.

17. Cleaning apparatus according to claim 15, with the conveyor track being designed to slope upward from an entry point (1) to an exit point (2).

18. Cleaning apparatus according to claim 14, with the conveyor track being designed essentially in the form of a horizontal plane with several sequentially arranged cleaning stations (10,17).

19. Cleaning apparatus according to claim 14, with the conveyor track being designed in such a way that the sail (5) remains essentially free of tumbling and essentially does not undergo any bending as it passes along the conveyor track.

20. Cleaning apparatus according to claim 14, with a separator, preferably a suction device (16), being provided at the exit point of each cleaning station (10, 17), to remove residual cleaning solution from the sail (5) as it leaves the cleaning station.

21. Cleaning apparatus according to claim 14, with each of the cleaning stations possessing a fluid basin (11), at each of which at least one roller (13, 14) is positioned perpendicular to the direction of forward motion.

22. Cleaning apparatus according to claim 14, with at least one cleaning station (10, 17) having a cleaning element, in particular a brush that can be moved across the sail to be cleaned.

23. Cleaning apparatus according to claim 14, with at least one cleaning station (10, 17) possessing two cleaning rollers, positioned on opposite sides of the sail passing through cleaning stations (10, 17), that brush across the sail in the direction opposite to the forward motion.

24. Cleaning apparatus according to claim 14, with at least one cleaning station (10, 17) having a cleaning roller that dips into a cleaning solution basin (11) and/or has cleaning solution outlet openings, in particular spray nozzles, for applying the cleaning solution to the sail (5).

25. Cleaning apparatus according to claim 14, with several cleaning roller pairs (13, 14) being provided that define a level conveyor track and that are arranged in pairs symmetrically with regard to a common plane constituted by the conveyor track.

26. Cleaning apparatus according to claim 14, with sequentially arranged, alternating pairs of cleaning rollers and conveyance rollers being provided, that can be driven at different peripheral speeds.

27. Cleaning apparatus according to claim 14, with a main washing station (17) being provided that has a fresh water feed (19) and a cleaning solution dosing mechanism (20).

28. Cleaning apparatus according to claim 27, with a prewashing station (10) being positioned ahead of main washing station (17), which can be fed with cleaning solution from main washing station (17).

29. Cleaning apparatus according to claim 14, with a supplemental treatment station (13) being provided that has an application mechanism for applying supplemental treatment substances to the sail (5).

30. Cleaning apparatus according to claim 14, with a drying station (26) positioned after cleaning stations (10, 17) being provided, that has a stationary heated support surface (27).

31. Cleaning apparatus according to claim 14, with conveyance mechanism (4) having conveyance rollers that rotate in opposite directions.

32. The apparatus of claim 14 further including at least one fluid removal device (16) positioned between two compartmented cleaning stations (10, 17).

33. The cleaning apparatus of claim 14, structured and arranged to clean both sides of the sail at the same time.

34. The cleaning apparatus according to claim 33, wherein said conveyor track is structured and arranged to convey the sail above cleaning solution situated in the individually compartmented and spaced-apart cleaning stations and additionally comprising pairs of rollers arranged to apply the cleaning solution to both sides of the sail passing therethrough.

* * * * *